US010950188B2

(12) United States Patent
Shi et al.

(10) Patent No.: US 10,950,188 B2
(45) Date of Patent: Mar. 16, 2021

(54) DRIVING METHOD OF A BACKLIGHT, DRIVING DEVICE, BACKLIGHT, DISPLAY ASSEMBLY AND VIRTUAL REALITY APPARATUS

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Tiankuo Shi, Beijing (CN); Lingyun Shi, Beijing (CN); Zhihua Ji, Beijing (CN); Chuanjun Liu, Beijing (CN); Guangquan Wang, Beijing (CN); Ming Chen, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/453,502

(22) Filed: Jun. 26, 2019

(65) Prior Publication Data

US 2020/0035170 A1 Jan. 30, 2020

(30) Foreign Application Priority Data

Jul. 30, 2018 (CN) ..... 201810852638.6

(51) Int. Cl.
*G09G 5/10* (2006.01)
*G09G 3/34* (2006.01)

(52) U.S. Cl.
CPC ..... *G09G 3/342* (2013.01); *G09G 2320/0257* (2013.01); *G09G 2320/0626* (2013.01); *G09G 2360/16* (2013.01)

(58) Field of Classification Search
CPC ... G09G 2320/0247; G09G 2320/0257; G09G 2320/0626; G09G 2360/16; G09G 3/342; G09G 3/3426
See application file for complete search history.

(56) References Cited

U.S. PATENT DOCUMENTS 8,842,140 B2 9/2014 Oniki
2012/0162289 A1* 6/2012 Oniki ..... G09G 3/342 345/690

(Continued)

FOREIGN PATENT DOCUMENTS

CN 1811536 A 8/2006
CN 101377901 A 3/2009

(Continued)

OTHER PUBLICATIONS

First Office Action, including Search Report, for Chinese Patent Application No. 201810852638.6, dated Aug. 30, 2019, 14 pages.

*Primary Examiner* — Insa Sadio
(74) *Attorney, Agent, or Firm* — Westman, Champlin & Koehler, P.A.

(57) ABSTRACT

The preset disclosure provides a driving method of a backlight, a backlight driving device, a backlight, a display assembly and a virtual reality apparatus. The backlight includes multiple rows of light sources arranged in an array. The driving method includes: after a preset time has elapsed from receipt of a synchronous display signal for each frame of image, lighting the light sources row by row, wherein each row of light sources is successively lit at least twice.

11 Claims, 3 Drawing Sheets

(56) References Cited

U.S. PATENT DOCUMENTS

| | | | | |
|---|---|---|---|---|
| 2018/0040279 | A1* | 2/2018 | Kimura | G09G 3/342 |
| 2018/0210251 | A1* | 7/2018 | Kimura | G02F 1/13624 |
| 2019/0027107 | A1 | 1/2019 | Zhang | |
| 2019/0180698 | A1 | 6/2019 | Gu et al. | |

FOREIGN PATENT DOCUMENTS

| | | | |
|---|---|---|---|
| CN | 102473394 | A | 5/2012 |
| CN | 103035217 | A | 4/2013 |
| CN | 104050931 | A | 9/2014 |
| CN | 107290883 | A | 10/2017 |
| CN | 107688240 | A | 2/2018 |
| CN | 107978280 | A | 5/2018 |
| EP | 1 605 434 | A1 | 12/2005 |
| JP | 2007-79079 | A | 3/2007 |

* cited by examiner

DRIVING METHOD OF A BACKLIGHT, DRIVING DEVICE, BACKLIGHT, DISPLAY ASSEMBLY AND VIRTUAL REALITY APPARATUS

CROSS-REFERENCE TO RELATED APPLICATION

The present application claims the priority of Chinese Patent Application No. 201810852638.6 filed on Jul. 30, 2018, the contents of which are incorporated herein in their entirety by reference.

TECHNICAL FIELD

The present disclosure relates to the field of display technology, and in particular to a driving method of a backlight, a backlight driving device and a backlight.

BACKGROUND

Virtual reality (VR) technology is a computer simulation technology that can create a virtual world to experience. Computer technology and display technology are combined in VR applications to construct a virtual environment that allows users to immerse in the virtual environment with a strong immersion.

A VR apparatus includes a display assembly which may be a liquid crystal display assembly. The liquid crystal display assembly has a backlight. When the display assembly displays images, the backlight is always lit.

Generally, the liquid crystal display assembly applied in the VR apparatus is required to provide a frame rate for displaying images higher than that of a common display assembly, and has a higher response speed. While displaying images, the liquid crystal display assembly in the related art is likely to cause residual image, deteriorating the display effect.

SUMMARY

According to an aspect of embodiments of the present disclosure, a driving method of a backlight is provided, the backlight including multiple rows of light sources arranged in an array, the driving method including: after a preset time has elapsed from receipt of a synchronous display signal for each frame of image, lighting the light sources row by row, wherein each row of light sources is successively lit at least twice.

Optionally, in the driving method provided in the embodiments of the present disclosure, a brightness of each row of light sources is changed progressively during the at least two successive lighting.

Optionally, in the driving method provided in the embodiments of the present disclosure, for each row of light sources, a brightness difference between two adjacent lightings of each row of light sources is less than a first brightness threshold.

Optionally, in the driving method provided in the embodiments of the present disclosure, the backlight is divided into multiple preset regions, and the driving method includes:

for each preset region, acquiring an average brightness value of a portion in a current frame of display image that corresponds to the preset region, as a first brightness value;

acquiring an average brightness value of a portion of a previous frame of display image that corresponds to the preset region, as a second brightness value;

calculating a difference between the first brightness value and the second brightness value, and, if the brightness difference is greater than a second brightness threshold, making the light sources in the preset region lit successively with a progressively changing brightness; or, if the brightness difference is not greater than the second brightness threshold, lighting the rows of light sources in the preset region successively with a constant brightness.

Optionally, in the driving method provided in the embodiments of the present disclosure, each preset region includes one row of light sources.

Optionally, in the driving method provided in the embodiments of the present disclosure, a column number of any preset region is less than a column number of the array of light sources.

According to another aspect of the embodiments of the present disclosure, a backlight driving device is provided, the backlight including multiple rows of light source arranged in an array, and the backlight driving device including:

a synchronizing circuit configured to receive a synchronous display signal for one frame of display image, and provide a backlight driving initial signal after a preset time has elapsed;

a driving circuit configured to light the light sources row by row according to the backlight driving initial signal, wherein each row of light sources is successively lit at least twice.

Optionally, in the driving device provided in the embodiments of the present disclosure, the driving circuit is configured to control the brightness of each row of light sources change progressively during the at least two successive lighting.

Optionally, in the driving device provided in the embodiments of the present disclosure, the driving circuit is configured to control so that a brightness difference between two adjacent lightings of each row of light sources is less than a first brightness threshold.

Optionally, in the driving device provided in the embodiments of the present disclosure, the backlight is divided into multiple preset regions, and the driving circuit is configured to: for each preset region, acquire an average brightness value of a portion in a current frame of display image that corresponds to the preset region, as a first brightness value; acquire an average brightness value of a portion of a previous frame of display image that corresponds to the preset region, as a second brightness value; calculate a difference between the first brightness value and the second brightness value, and, if the brightness difference is greater than a second brightness threshold, make the light sources in the preset region lit successively with a progressively changing brightness; or, if the brightness difference is not greater than the second brightness threshold, make the light sources in the preset region lit successively with a constant brightness.

According to still another aspect of the embodiments of the present disclosure, a backlight applied to a display assembly is provided, the backlight including a driving chip and multiple rows of light sources arranged in an array, the driving chip including the above backlight driving device.

According to still another aspect of the embodiments of the present disclosure, a display assembly is provided, which includes a display panel and the above backlight, the backlight being located at a light incoming surface of the display panel.

According to still another aspect of the embodiments of the present disclosure, a virtual reality apparatus is provided, which includes the above display assembly.

It should be appreciated that, the above general descriptions and the following detailed description are merely exemplary and explanatory, and cannot used to limit the present disclosure.

BRIEF DESCRIPTION OF THE DRAWINGS

The drawings, which are incorporated into and become a part of the specification, illustrate the embodiments according to the present disclosure, and are used to explain the principles of the present disclosure together with the specification.

DETAILED DESCRIPTION

Figure 1:
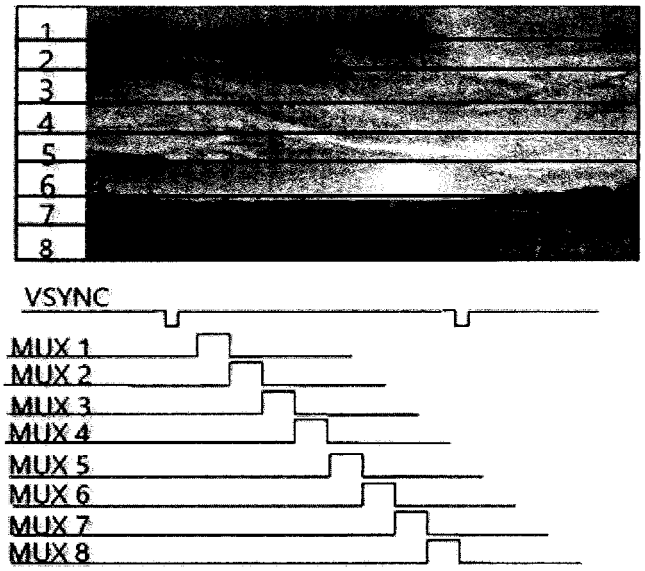
FIG. 1 is a timing diagram of driving signals for driving rows of light sources in a backlight, provided by the related art.

Exemplary embodiments will be described in detail herein, examples of which are illustrated in the drawings. When the following descriptions relate to the drawings, the same or like numerals in various figures indicate the same or like elements unless otherwise indicated. The implementations described in the following exemplary embodiments do not represent all embodiments consistent with the present disclosure. Instead, they are merely examples of devices and methods consistent with some aspects of the present disclosure as detailed in the appended claims.

A liquid crystal display assembly includes a display panel and a backlight. The backlight provides backlighting for the liquid crystal display panel to display images.

The display panel generally includes a color filter substrate and an array substrate. A liquid crystal layer is provided between the color filter substrate and the array substrate. A color filtering layer is provided on the color filter substrate, and thin film transistors are provided on the array substrate. A common electrode and pixel electrodes may be provided on the color filter substrate and the array substrate, respectively; alternatively, the common electrode and the pixel electrodes may be provided on the array substrate. A common voltage signal is loaded to the common electrode, and pixel voltage signals may be applied to the pixel electrodes via the thin film transistors. An electrical field is formed by the common electrode and the pixel electrodes to control the liquid crystal molecules in the liquid crystal layer to rotate, so that the light emitted from the backlight is transmitted through the rotated liquid crystal molecules.

The rotation angle and the rotation direction of the liquid crystal molecules can be changed by changing the magnitude of the voltage applied to the pixel electrodes. It takes a certain time for the liquid crystal molecules to rotate from one angle to another, which is called a response time of the liquid crystal, that is, the time required for the pixels to turn from dark to bright or from bright to dark. The response time reflects the response speed of the liquid crystal to the input signal. The shorter the response time of the liquid crystal, the faster the response speed, and the smoother the display image.

The liquid crystal display assembly (hereinafter referred to as the display assembly) applied to the VR apparatus needs to have a faster response speed, but it is difficult for the liquid crystal display assembly in the related art to satisfy the requirement of the VR device for the response speed of the display assembly, and thus the problem of residual image is apt to occur. The so-called "residual image" refers to the problem that when the display images are switched, the previous display image still remains partially on the screen. For the liquid crystal display assembly, such problem of residual image is resulted from the response time required for the liquid crystal molecules to deflect. The response time varies depending on different liquid crystal molecular materials or different driving technologies.

In view of the above problem, the related art provides a solution as follows: during the time when the display assembly displays one frame of image, the backlight is turned on after the liquid crystal response is completed. In this case, for the backlight which is formed by multiple light emitting diodes (LEDs) arranged in an array, the manner for controlling the backlight to be lit is that all the multiple LEDs should be lit simultaneously. This requires that the driving chip for driving the backlight has a higher driving capability, and the driving chip occupies a larger area.

Another solution provided by the related art is as follows: the backlight is controlled to be turned on in a successive manner. Specifically, during the time when one frame of image is displayed, individual rows of LEDs are turned on in sequence. Referring to the display image and the timing diagram of the driving signals for lighting the backlight shown in FIG. 1, the liquid crystal display assembly adopts a direct type backlight, and the backlight is located below the display panel. It is assumed that the backlight includes 8 rows of light sources arranged in an array, the frame of image in FIG. 1 is to be displayed, and the driving signals provided for respective light sources are the signals as shown in FIG. 1. The symbol "VSYNC" in FIG. 1 represents an image synchronous display signal VSYNC, and the symbols "MUX1" to "MUX8" represents the driving signals for the first row to the eighth row of light sources, respectively. The driving signals are also pulse signals.

The synchronous display signal VSYNC is a pulse signal. The time interval between two pulses is the time for displaying one frame of image. Each row of light sources is turned on during a pulse high level time of a driving signal. It can be seen from the driving signals of the backlight of FIG. 1 that, the individual rows of light sources are turned on sequentially during the time for displaying one frame of image.

Since the time for displaying one frame of image is less than the visual persistence time, lighting the light sources in turn does not affect the human eye to view the images.

The display assembly displays the images at a certain frame rate. The frame rate (also known as the scanning frequency or the vertical scanning frequency or the refresh frequency) is the number of frames displayed per second in units of Hertz (Hz). Optionally, if the frame rate is 75 Hz, 75 frames is displayed per second.

The time for displaying one frame is equal to the reciprocal of the frame rate. The higher the frame rate, the shorter the time for displaying one frame, that is, the higher the refresh rate of the images. Optionally, if the frame rate is 75 Hz, the time for displaying one frame is 1/75, about 13 ms.

Generally, since the human eye has an upper limit on the ability to recognize a dynamically changing image, when the refresh frequency of the display images is sufficiently high, the human eye will not perceive the high frequency switching of the images, that is, the image flickering will not be perceived; accordingly, for the images with a lower refresh frequency, the human eye perceives a certain degree of flickering. Optionally, for a display refresh frequency above 85 Hz, it is generally sufficient to completely eliminate the flickering.

In the above manner of lighting the light sources row by row, it is necessary to light individual rows of the light sources in sequence in the time for displaying one frame of image. If the refresh frequency that is used to turn on and off the light sources row by row does not reach a corresponding threshold, it is possible that the scanning frequency of the backlight is not high enough, causing a slight flickering of the images.

In view of above, the present disclosure provides a driving method of a backlight which can solve the problem of residual image by changing the driving manner for the LED light sources in the backlight without causing the image flickering, thus improving the image display quality.

Several embodiments are given below for describing the technical solutions of the present application. The following specific embodiments may be combined with each other, and the same or similar concepts or processes may not be repeated in some embodiments.

Figure 2:
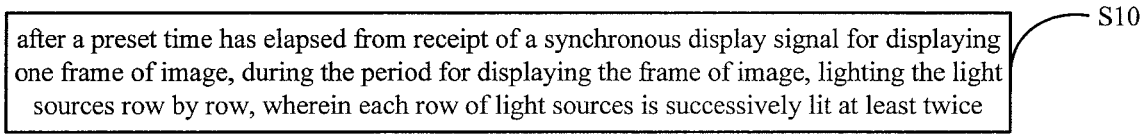
FIG. 2 is a flow chart of a driving method of a backlight illustrated according to an exemplary embodiment of the present disclosure.

An exemplary embodiment of the present disclosure provides a driving method of a backlight which is applied to a liquid crystal display assembly, wherein the backlight includes multiple rows of light source arranged in an array. As shown in FIG. 2, the method includes:

Step S10, after a preset time has elapsed from receipt of a synchronous display signal for displaying one frame of image by a liquid crystal display assembly, during the period for displaying one frame of image, lighting the light sources row by row, wherein each row of light sources is successively lit at least twice.

The above driving method of a backlight may be applied to a liquid crystal display assembly which includes a display panel and a backlight. The backlight may be a direct type backlight, and is disposed below the display panel. That is to say, the light from the backlight is directly incident on the display panel without being reflected by a light guide plate; alternatively, the backlight may be an edge type backlight, and includes multiple light sources arranged along one direction; each light source can be treated as a single row.

The backlight includes multiple rows of light sources which may be light emitting diodes (LEDs), for example. As a light source, the LED has characteristics of high brightness and low power consumption.

When the display assembly displays images, the period for display each frame of image is controlled by the synchronous display signal VSYNC. The synchronous display signal VSYNC is a pulse signal. The time interval between two pulses is the time for displaying one frame of image. Each time the display assembly receives the synchronous display signal, a voltage signal is applied to the liquid crystal layer in the display assembly to control the liquid crystal molecules in the liquid crystal layer to rotate from the previous angle to another angle. The time required for the liquid crystal molecules to complete the rotation process is called a response time, and the light emitted by the backlight is transmitted after the response of the liquid crystal molecules is completed.

In the present embodiment, after a preset time (it may be set according to practical requirements) has elapsed from receipt of a synchronous display signal, i.e., after a certain time has lapsed since a synchronous display signal is received, the light sources are turned on row by row during the period for displaying one frame of image after the liquid crystal response is completed. Before the response of the liquid crystal molecules is completed, the backlight will not be turned on, and thus the current frame of image will not be displayed. The backlight is turned on to display the current frame of image only if the response of the liquid crystal molecules is completed. Therefore, one frame of image will not be displayed when the response of the liquid crystal molecules is not completed, which may eliminate the visual persistence and avoid the problem of residual image.

The light sources are turned on row by row during the period for displaying one frame of image, that is, the individual rows of light sources are turned on sequentially by scanning in a frame time. In a frame time, the individual rows of light sources are turned on in sequence; the light sources in a same row are turned on simultaneously, and the light sources in different rows are turned on sequentially.

Moreover, each row of light sources is turned on successively at least twice. In other words, the number of times that each row of light sources is turned on and then turned off is at least two. Each time a row of light sources is turned on and then turned off, the row of light sources is regarded as being lit once. Since each row of light sources is lit successively multiple times, the refresh frequency of the light sources may be improved, further avoiding the problem of image flickering caused by lighting the light sources row by row.

Figure 3:
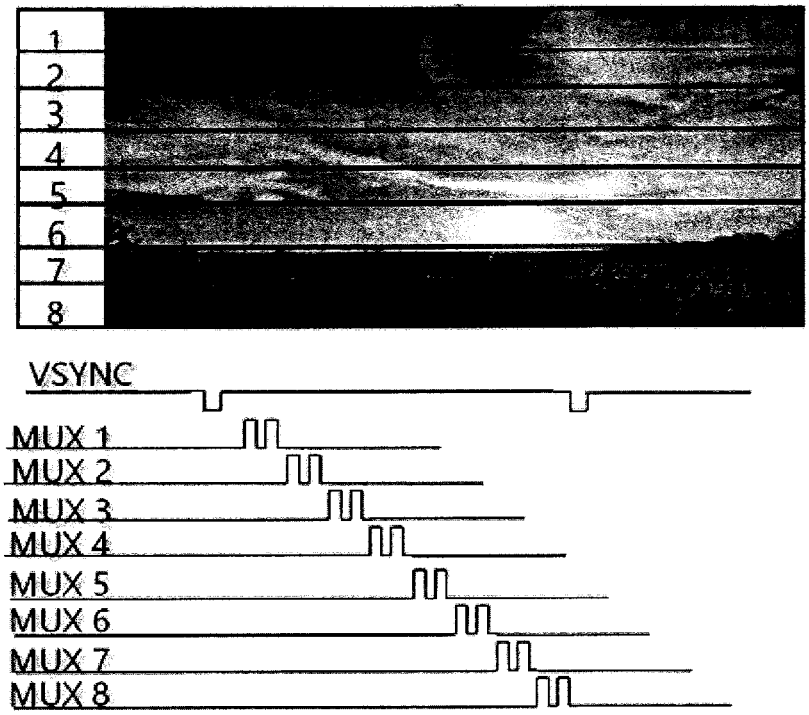
FIG. 3 is a timing diagram of driving signals for driving rows of light sources in a backlight, according to an exemplary embodiment of the present disclosure.

Next, the driving method of a backlight of the above embodiment will be described in detail with reference to the display image and the timing diagram of the driving signals for lighting the backlight shown in FIG. 3.

It is assumed that the backlight includes 8 rows of light sources arranged in an array. To display the frame of image as shown in FIG. 3, the driving signals provided to the rows of light sources are the pulse signals in FIG. 3. The symbol "VSYNC" represents an image synchronous display signal VSYNC, and the symbols "MUX1" to "MUX8" represents the driving signals for the first row to the eighth row of light sources, respectively.

The synchronous display signal VSYNC is a pulse signal. The time interval between two pulses is the time for displaying one frame of image. The driving signal for each light source is also a pulse signal. Each row of light source is turned on during the time of pulse high level. It can be seen from the backlight driving signals illustrated in FIG. 3 that, during the time for displaying one frame of image, the individual rows of light sources are turned on sequentially; moreover, the driving signal for each light sources includes two pulses; during the time of high level of each pulse, the corresponding row of light sources is turned on, and during the time of low level of each pulse, the corresponding row of light sources is turned off; therefore, each row of light sources is lit twice.

The number of times that each row of light sources is successively lit may be controlled by the number of pulses of the drive signal supplied to each row of light sources. The time interval between two successive lightings of the light sources is related to the interval between two adjacent pulses. The brightness of a light source in an on state is proportional to the duty cycle of the pulse (a ratio of the time of high level to the pulse period is called duty cycle). Thus, as for the number of times that each row of light sources is lit successively, the time interval, the brightness, etc., may be set as needed.

In some embodiments, the brightness of each row of light sources is changed each time the row of light sources are turned on. The words "changed each time" here mean that a brightness gradient is formed during the switching between two adjacent frames of images to make a smooth transition. Optionally, if the average brightness of the current frame of display image is greater than that of the previous frame of display image, the brightness of each row of light sources is increased progressively when they are turned on at least twice; if the average brightness of the current frame of display image is less than that of the previous frame of display image, the brightness of each row of light sources is decreased progressively when they are turned on at least twice.

As for each row of light sources, if the brightness is increased progressively when they are lit multiple times, the brightness for the next time is greater than the brightness for the previous time. That is, the brightness of a row of light sources is increased each time they are lit during the multiple successive lightings, which results in a more smooth and natural transition of the brightness, and improves the image display effect. The case that the brightness of each row of light sources is decreased progressively during multiple successive lightings is similar to this, and will not be repeated here.

The brightness of a light source is related to the duty cycle of the pulse signal. The duty cycles of the pulses in the driving signal provided for each row of light sources may be increased in sequence so as to make the brightness of the row of light sources increase each time they are lit.

Figure 4:
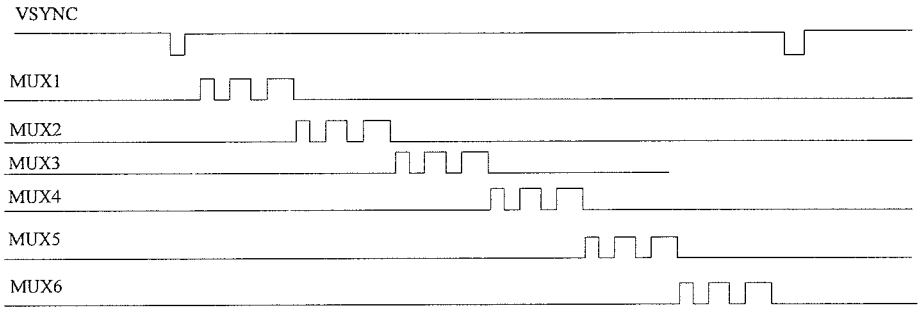
FIG. 4 is a timing diagram of driving signals for driving rows of light sources in a backlight, according to another exemplary embodiment of the present disclosure.

Taking the case shown in FIG. 4 as an example, it is assumed that the backlight includes 6 rows of light sources arranged in an array. The symbol "VSYNC" in FIG. 4 represents an image synchronous display signal VSYNC, and the symbols "MUX1" to "MUX6" represents the driving signals for the first row to the sixth row of light sources, respectively. As shown in FIG. 4, the driving signal for each row of light sources includes three pulses. During a time of high level of each pulse, a corresponding row of light sources is turned on; during a time of low level of the pulse, this row of light sources is turned off; each row of light sources is turned on and off successively three times. Furthermore, since the duty cycles of the three pulses are increased in sequence, the brightness of the corresponding row of light sources is increased each time they are lit. That is, the brightness of the light sources when they are lit at the first time is less than that of the light sources when they are lit at the second time, and the brightness of the light sources when they are lit at the second time is less than that of the light sources when they are lit at the third time.

Further, as for each row of light sources, the brightness difference between two adjacent lightings of each row of light sources is less than a first brightness threshold. The number of times that each row of light sources is lit successively may be set appropriately according to the set first brightness threshold (i.e., a brightness gradient between two adjacent displays), and will not be limited specifically in the present disclosure.

In the present embodiment, as for each row of light sources which are lit multiple times, the brightness difference between two adjacent lightings of each row of light sources is less than a first brightness threshold. That is to say, the difference between the brightness when a light source is lit at a next time and the brightness when the light source is lit at the previous time is small, which can make the brightness of the light source changed as smoothly as possible between any two adjacent lightings of the light source, and further improve the image display effect.

In an optional implementation, the step of lighting the light sources row by row and lighting each row of light sources successively at least twice during the time when one frame of image is displayed includes:

Step S11, for each preset region, acquiring an average brightness value of a portion in a current frame of display image that corresponds to the preset region, as a first brightness value;

Step S12, acquiring an average brightness value of a portion of a previous frame of display image that corresponds to the preset region, as a second brightness value;

Step S13, calculating a difference between the first brightness value and the second brightness value, and, if the brightness difference is greater than a second brightness threshold, making the light sources in the preset region turned on successively with a progressively changed brightness; alternatively, if the brightness difference is not greater than the second brightness threshold, making the light sources in the preset region turned on successively with a constant brightness.

The above second brightness threshold may be set according to a specific application scenario. According to an embodiment of the present disclosure, if the brightness difference of two adjacent frames of display images is too large, or the brightness difference for any preset region in two adjacent frames of display images is too large, the light sources in each row or some of the light sources in each row which are within the preset region are set to be successively turned on with a progressively changing brightness. Optionally, as mentioned above, the display is performed from a display image with a lower brightness and the brightness is increased gradually; alternatively, the display is performed from a display image with a higher brightness and the brightness is decreased gradually. On the other hand, if the brightness difference of two adjacent frames of display images is lower than the second brightness threshold, or the brightness difference for any preset region in two adjacent frames of display images is lower the second brightness threshold, there is no need to set a progressively changing brightness gradient, but a brightness of the current display image at a corresponding location, for example, may be applied at the beginning of the successive lightings.

According to some embodiments of the present disclosure, the backlight may be driven by region. Different regions uses different driving signals. For each region, there are multiple rows of light sources, and different regions have different brightness; however, the light sources in a same row are still lit simultaneously, and the light sources are also lit row by row. According to some embodiments of the present disclosure, it may be determined, according to the difference of the brightness of various regions in two adjacent display images, whether any light source (pixel) are successively lit multiple times with different brightness during scanning in the row-by-row manner; meanwhile, the whole backlight is lit in the above row-by-row manner, that is, during lighting any row of light sources successively, some light sources in this row of light sources have a progressively changing brightness when they are lit successively while the other light sources have a constant brightness. During scanning row by row, the individual light sources in each row are lit successively in a synchronous manner (refreshed synchronously).

Optionally, the average brightness value of the pixels in each preset region may be calculated, and the average brightness value of a preset region for a previous display image may be compared with that of this preset region for the current display image. If a different of the average brightness values exceeds a set threshold, the light sources corresponding to the region are provided with progressively changing brightness values so that any light source in the region is driven to be lit with a progressively changing brightness when this light source is scanned during the row-by-row scanning; meanwhile, as for a region in which the difference of the average brightness value is less than the threshold, the light sources within the region are provided with a same brightness value. Optionally, the light sources have a brightness value corresponding to the current display image when they are lit the first time.

In the above embodiment of the present disclosure, the backlight may be divided into multiple preset regions. Each preset region may include one row of light sources; alternatively, each preset region may include at least two rows of light sources; alternatively, each preset region includes multiple rows and columns, wherein the column number of any preset region is smaller than the column number of the backlight matrix so that any scanned row (scanning all the light sources arranged in one row) passes through at least two preset regions (i.e., the whole backlight matrix is divided into a plurality of rectangular regions). Also, the division manner of the preset regions is not limited to the descriptions in the preset disclosure.

For each region of the backlight, a first brightness value for displaying the current frame of image and a second brightness value for displaying the previous frame of image are acquired, respectively. The first brightness value is a predicted brightness value of a region for displaying the current frame of image calculated by a related algorithm; and the second brightness value is an actual brightness value for displaying the previous frame of image calculated by a related algorithm, and may be pre-stored. Optionally, the first brightness value may be acquired by performing a brightness value evaluation on the display data of the current display image, and the actual brightness value of a preset region for the previous display image may be read from a cache field set for the preset region; alternatively, the above first and second brightness values may be acquired by any other proper manner, and is not limited in the present disclosure.

For each of the regions of the backlight, the difference between the first brightness value and the second brightness value of each region is calculated, and the obtained difference is compared with the second brightness threshold. For a region, if the difference is greater than the second brightness threshold, it indicates that the brightness of the current frame of image is significantly different from that of the previous frame of image. In this case, in order to make a more natural transition between the brightness of the two frames of images for this region, during the time for displaying the current frame of image, the light sources are lit row by row and each row of light sources has a progressively changing brightness when they are successively lit. In other words, if each row of light sources is lit multiple times, the brightness is increased or decreased progressively (the brightness is changed step by step), which results in a more smooth and natural transition of the brightness between two adjacent images, and improves the image display effect.

Specifically, as for a certain region, when the first brightness value of the region is greater than the second brightness value of the region, and the difference therebetween is greater than the second brightness threshold, it indicates that the brightness of the current frame of image is greater than the brightness of the previous frame of image, and the change in the brightness is great. In this case, when each row of light sources is lit successively multiple times, the brightness is increased progressively. When the first brightness value of the region is smaller than the second brightness value of the region, and the difference therebetween is smaller than the second brightness threshold, it indicates that the brightness of the current frame of image is smaller than the brightness of the previous frame of image, and the change in the brightness is great. In this case, when each row of light sources is lit successively multiple times, the brightness is decreased progressively.

It should be noted that, the brightness for each row of light sources when they are lit and the brightness difference between adjacent lightings may be set as needed.

An embodiment of the present disclosure further provides a backlight driving device applied to a display assembly. The backlight includes multiple rows of light sources arranged in an array. The device includes:

a synchronizing circuit configured to receive a synchronous display signal for displaying one frame of image by the display assembly, and transmit a backlight driving initial signal after a preset time has elapsed;

a driving circuit configured to receive the backlight driving initial signal, and light the light sources row by row during a time for displaying one frame of image, wherein each row of light sources is driven to be lit at least twice; the preset time is greater than a response time of liquid crystal molecules in the liquid crystal display assembly.

In some examples, the brightness of each row of light sources is increased progressively when they are lit.

In some examples, as for each row of light sources, the brightness difference between two adjacent lightings of each row of light sources is less than a first brightness threshold.

In an optional implementation, the driving circuit is configured to:

acquire a brightness of each region of the backlight for displaying a current frame of image as a first brightness value;

acquire a brightness of each region of the backlight for displaying a previous frame of image as a second brightness value;

during a time for display the current frame of image by the liquid crystal display, lighting each row of light sources in the region row by row, and making the brightness of each row of light sources changed progressively when they are lit.

Similar to the above embodiment of the driving method of a backlight, the driving device provided by the present disclosure can solve the problem of residual image by changing the driving manner for the LED light sources in the backlight without causing the image flickering, thus improving the image display quality.

As for the device embodiment, the detailed implementation process of the functions and the effects of the units or sub-units in the device may be referred to the implementation process of the corresponding steps in the above method, and will not be repeated here.

As for the device embodiment, since it generally corresponds to the method embodiment, the relevant parts can be referred to the description of the method embodiment. With the description of the foregoing implementations, the device in the present embodiment may be implemented by means of software, or by combination of software and necessary general hardware, and may also be implemented by hardware. Based on such understanding, the essential technical solution of the present disclosure or the part of the present disclosure that contributes to the prior art may be embodied in the form of a software product. Taking a software implementation as an example, a device in the logical sense is formed by reading corresponding computer program instructions in the non-volatile memory into the internal memory by the processor in which the device is located.

The present disclosure further provides a computer readable storage medium having stored thereon a computer program, the program being executed by a processor to implement the driving method described in any of the above embodiments.

An embodiment of the present disclosure further provides a backlight applied to a display assembly, the backlight including a driving chip and multiple rows of light sources arranged in an array, the driving chip including a backlight driving device described in any of the above embodiments.

An embodiment of the present disclosure further provides a liquid crystal display assembly including a display panel and the backlight as mentioned above, the backlight being located below the display panel.

Figure 5:
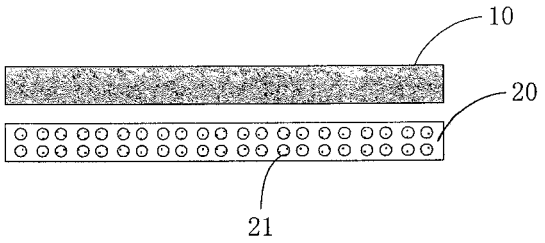
FIG. 5 is a schematic diagram of a cross-section structure of a display assembly illustrated according to an exemplary embodiment of the present disclosure.
Figure 6:
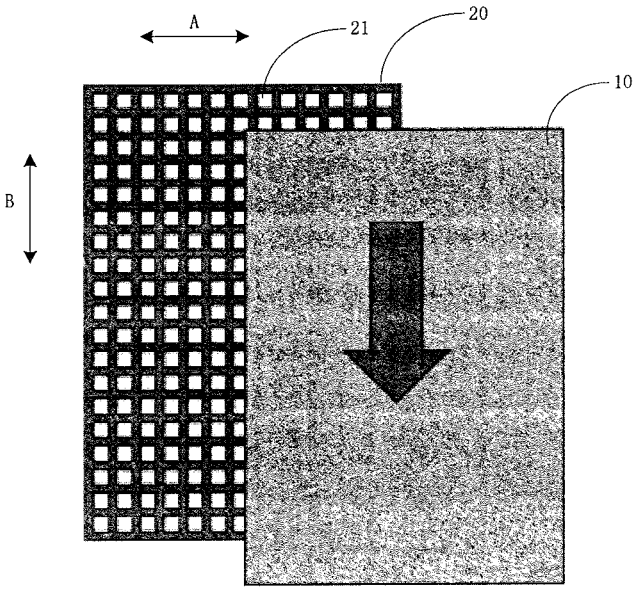
FIG. 6 is a schematic diagram of a three-dimensional structure of a display assembly illustrated according to an exemplary embodiment of the present disclosure.

Referring to a display assembly shown in FIGS. 5 and 6, the display assembly includes a display panel 10 and a backlight 20 located at a light incoming surface of the display panel. The backlight 20 includes multiple rows of light sources 21 arranged in an array. FIG. 6 is a perspective view of the display assembly, schematically showing the relative positions of the backlight 20 and the display panel 10. Referring to the cross sectional diagram as shown in FIG. 5, the backlight 20 is located below the display panel 10, and the light emitted by the backlight 20 is directly incident on the display panel 10, thus the backlight is a direct type backlight.

Specifically, as shown in FIG. 6, the backlight includes multiple rows of light sources arranged in an array. Optionally, the direction indicated by the solid row B with double arrows in the figure is the row direction of the backlight, and the direction indicated by the solid row A with double arrows is the column direction of the backlight. The rows of light sources can be lit row by row along the column direction of the backlight (e.g., from left to right in the figure). After a preset time has elapsed from receipt of a synchronous display signal for displaying one frame of image by a display assembly, during the period for displaying one frame of image, the rows of light sources are lit in sequence. The liquid crystal molecules provided in the liquid crystal layer of the display panel allow the light emitted by the backlight to transmit therethrough after the response of the liquid crystal molecules is completed, thereby displaying one frame of image by the display panel.

The display assembly, in which the driving chip of the backlight includes the backlight driving device described in any of the above embodiments, can avoid the problem of residual image, and will not cause the problem of image flickering.

The present disclosure further provides a virtual reality apparatus including the display assembly described in above embodiment.

The virtual reality apparatus, in which the backlight in the display assembly includes the backlight which is provided by the above embodiment and uses the driving method of any of the above embodiments, can avoid the problem of residual image, and will not cause the problem of image flickering. Such characteristics satisfy the high frame rate requirement for display images of the display assembly in the virtual reality apparatus, and are beneficial for improving the image smoothness of the virtual reality device.

The machine-readable storage medium as mentioned herein may be any electronic, magnetic, optical, or other physical storage device that can contain or store information such as executable instructions, data, and so forth. For example, the machine-readable storage medium may be: a RAM (Radom Access Memory), a volatile memory, a non-volatile memory, a flash memory, a storage driver (such as a hard disk drive), any type of storage disk (such as a disk, a DVD, etc.), or a similar storage medium, or a combination thereof.

Other embodiments of the present disclosure will be readily apparent to those skilled in the art after considering the specification and practicing the disclosure herein. The present disclosure is intended to cover any variations, uses, or adaptations of the present disclosure, which are in accordance with the general principles of the present disclosure and include common general knowledge or conventional technical means in the art that are not disclosed in the present disclosure. The specification and examples are to be regarded as illustrative only, and the scope and spirit of the present disclosure are pointed out by claims.

It should be understood that the invention is not limited to the detailed structures having been described above and illustrated in the drawings. Various modifications and changes can be made without departing from the scope of the present disclosure. The scope of the present disclosure is limited only by the appended claims.

What is claimed is:

1. A driving method of a backlight, the backlight comprising multiple rows of light sources arranged in an array, the driving method comprising:

after a preset time has elapsed from receipt of a synchronous display signal for each frame of display image, lighting the light sources row by row, wherein each row of light sources is successively lit at least twice, wherein a brightness of each row of light sources is changed progressively during the at least two successive lighting, wherein the backlight is divided into a plurality of preset regions, and the driving method comprises:

acquiring, for each preset region, an average brightness value of a portion in a current frame of display image that corresponds to the preset region, as a first brightness value;

acquiring an average brightness value of a portion in a previous frame of display image that corresponds to the preset region, as a second brightness value; and calculating a brightness difference between the first brightness value and the second brightness value, and, if the brightness difference is greater than a second brightness threshold, lighting the rows of light sources in the preset region successively with a progressively changing brightness; if the brightness difference is not greater than the second brightness threshold, lighting the rows of light sources in the preset region successively with a constant brightness.

2. The driving method according to claim 1, wherein, a brightness difference between two adjacent lightings of each row of light sources is less than a first brightness threshold.

3. The driving method according to claim 1, wherein each preset region comprises one row of light sources.

4. The driving method according to claim 1, wherein a column number of any preset region is less than a column number of the array of light sources.

5. A backlight driving device for a backlight, wherein the backlight comprises multiple rows of light source arranged in an array, and the backlight driving device comprising:

a synchronizing circuit configured to receive a synchronous display signal for one frame of display image, and provide a backlight driving initial signal after a preset time has elapsed;

a driving circuit configured to light the light sources row by row according to the backlight driving initial signal, wherein each row of light sources is successively lit at least twice, wherein the driving circuit is configured to control the brightness of each row of light sources change progressively during the at least two successive lighting, wherein the backlight is divided into a plurality of preset regions, and the driving circuit is configured to:

acquire, for each preset region, an average brightness value of a portion in a current frame of display image that corresponds to the preset region, as a first brightness value; and acquire an average brightness value of a portion in a previous frame of display image that corresponds to the preset region, as a second brightness value; and calculate a brightness difference between the first brightness value and the second brightness value, and, if the brightness difference is greater than a second brightness threshold, light the rows of light sources in the preset region successively with a progressively changing brightness; if the brightness difference is not greater than the second brightness threshold, light the rows of light sources in the preset region successively with a constant brightness.

6. The backlight driving device according to claim 5, wherein, the driving circuit is configured to control that a brightness difference between two adjacent lightings of each row of light sources is less than a first brightness threshold.

7. The backlight driving device according to claim 5, wherein each preset region comprises one row of light sources.

8. The backlight driving device according to claim 5, wherein a column number of any preset region is less than a column number of the array of light sources.

9. A backlight applied to a display assembly, comprising a driving chip and multiple rows of light sources arranged in an array, the driving chip comprising the backlight driving device according to claim 5.

10. A display assembly comprising a display panel and the backlight according to claim 9, wherein the backlight is located at a light incoming surface of the display panel.

11. A virtual reality apparatus comprising the display assembly according to claim 10.

* * * * *